US007030577B2

(12) United States Patent
Kulish et al.

(10) Patent No.: US 7,030,577 B2
(45) Date of Patent: Apr. 18, 2006

(54) MULTI-CHANNEL UNDULATIVE INDUCTION ACCELERATOR

(75) Inventors: Victor V. Kulish, Kylv (UA); Alexandra C. Melnyk, Powel, OH (US); Aleck K. Landgraf, Columbus, OH (US)

(73) Assignee: Viara Research, LLC, Columbus, OH (US)

( * ) Notice: Subject to any disclaimer, the term of this patent is extended or adjusted under 35 U.S.C. 154(b) by 0 days.

(21) Appl. No.: 10/797,858

(22) Filed: Mar. 10, 2004

(65) Prior Publication Data

US 2005/0200322 A1 Sep. 15, 2005

(51) Int. Cl.
*H05H 9/00* (2006.01)

(52) U.S. Cl. ..... 315/505; 315/501; 250/491.1; 250/396 R

(58) Field of Classification Search ..... 315/505, 315/501, 500, 506, 507, 111.61
See application file for complete search history.

(56) References Cited

U.S. PATENT DOCUMENTS

| | | | | |
|---|---|---|---|---|
| 5,331,999 | A | 7/1994 | Jorgensen | 137/513.5 |
| 6,433,494 | B1 * | 8/2002 | Kulish et al. | 315/500 |
| 6,580,084 | B1 * | 6/2003 | Hiramoto et al. | 315/507 |
| 2002/0109472 | A1 * | 8/2002 | Kulish et al. | 315/505 |

* cited by examiner

*Primary Examiner*—Shih-Chao Chen
*Assistant Examiner*—Ephrem Alemu
(74) *Attorney, Agent, or Firm*—Mueller and Smith, LPA

(57) ABSTRACT

A multi-channel undulation induction accelerator of charged particles, comprising an injector block, drive source, output systems, turning systems, and induction acceleration block, which is made in the form of at least two one-channel linear induction acceleration blocks (including those that are placed parallel with one to other), linked by means of turning systems, each of which connects an output of one of the one-channel linear induction acceleration blocks with an input of another, similar block. At least one of the turning systems is made in the form of a sequence of fragments of solenoid, which are joined with each other in such a manner that they form a working channel for the charged particle beam, which accomplish a 180° or less angle turn.

5 Claims, 8 Drawing Sheets

MULTI-CHANNEL UNDULATIVE INDUCTION ACCELERATOR

CROSS-REFERENCE TO RELATED APPLICATIONS

STATEMENT REGARDING FEDERALLY SPONSORED RESEARCH

Not applicable.

BACKGROUND OF THE INVENTION

This invention is concerned with acceleration engineering, especially induction acceleration, and might be used as a commercial-type compact accelerator of charged particles for the formation of singular and multiple relativistic beams of charged particles, including beams of different energy and charge characteristics.

There is known an induction accelerator, which can be used as a device for the formation of singular electronic relativistic beams [Redinato L. "The advanced test accelerator (ATA), a 50-MeV, 10-kA Inductional Linac." *IEEE Trans.*, NS-30, No 4, pp. 2970–2973, 1983]. This device is called also the one-channel linear induction accelerator (OILINAC). The OILINAC is composed of an injector block, acceleration block, drive source, and output system. Its peculiarity is that the one-channel linear induction acceleration block is made in the form of a sequence of linearly united acceleration sections, which form, in turn, a linear accelerative working channel. The acceleration of the charged particle beam is achieved by the effect of accelerative action of longitudinal vortex high-frequency (tens MHz) electric field, which is generated within the working channel by alternating with time current in special inductor windings. The averaged energy rates of the acceleration for OILINAC are ~0.7–1.5 MeV/m. For example, in the above-mentioned design of OILINAC [Redinato L. "The advanced test accelerator (ATA), a 50-MeV, 10-kA Induction Linac." *IEEE Trans.*, NS-30, No 4, pp 2970–2973, 1983] the averaged acceleration energy rate is ~0.7 MeV/m. The other characteristic of the OILINAC is that only one electron beam is accelerated on all stages of the acceleration process.

Large linear dimensions, limited functional potentialities, and a limited current strength of the accelerating beam are the basic shortcomings of the OILINAC.

The large dimensions (e.g. 60–70 m length for OILINACs of the ATA class) cause severe complication of total infrastructure of its accommodation and service (it needs special accommodation, radiation-protection systems and service, etc.). As a result, the commercial application of the OILINAC as a basic design element for various types of commercial devices becomes economically unsuitable because of cost involved.

Practicality is predicated upon the formation of charged-particle beams with multi-component structure. For example the two-velocity electron beams for the superheterodyne free-electron lasers, complex (electron-ion or ion-ion) beams for some technology systems, etc. A direct use of OILINAC in such situations is impossible, since, as it was mentioned before, they are designed for the formation of exclusively one-energy and one-component relativistic beams of charged particles.

The limitation of the current strength of the beam is related with the increasing role of the beam instability at an increase of its density. Consequently the formation and the acceleration of long beams of tens kA's becomes technologically a very complicated problem and the formation of a many hundreds-kA beams becomes practically impossible.

There is also known an induction accelerator, which can work as a device for the formation of relativistic beams of charged particles and which is named the multi-channel induction linear accelerator (MILINAC) [V. V. Kulish, A. C. Melnyk. Multi-channel linear induction accelerator, U.S. Pat. No. 6,653,640 B2; issued Nov. 25, 2003.]. The MILINAC consists of an injector block, acceleration block, drive source, and output systems. Here the acceleration block consists of at least two one-channel linear induction acceleration blocks of the OILINAC (one-channel block); the injector block comprises one or more injectors, each of which is linked to an individual one-channel block. The charged-particles output systems are attached to the output systems of one-channel blocks. A design feature peculiarity of the output systems allows simultaneous acceleration of several separate charged particle beams. The output systems can have a form of systems for merging together the accelerated beams. It can bring together the beams of the same kind of charged particles as well as of different kinds of particle beams.

The above design overcomes a part of the noted above shortcomings of the OILINAC. This happens basically therefore that the MILINAC can drastically increase the total current of the accelerated multiple beams. Besides this MILINAC has a wide field of functional possibilities. This includes the formation of the two- and multi-velocity electron beams, combination electron-ion and ion-ion beams, beams of different kind of ions, e.g. positive and negative ion beams, etc.

Like in the case of OILINAC, the basic shortcoming of the MILINAC is its essential longitudinal dimensions, which are more pronounced when energies of accelerated beams become higher than ~10 MeV.

There is also known an induction accelerator, which is able to work as a device for the formation of the relativistic beams of charged particles [V. V. Kulish, P. B. Kosel, A. C. Melnyk, N. Kolcio Induction Undulative EH-Accelerator, U.S. Pat. No. 6,433,494 B1, issued Aug. 13, 2001]. It is also referred to as the multi-channel induction undulative accelerator (MIUNAC) or the EH-accelerator. This multi-channel undulation induction accelerator of charged particles comprises an injector block, drive source, output systems, turning systems, and an induction acceleration block. The latter block is made in the form of at least two one-channel linear induction acceleration blocks (including those that are placed parallel with one to other). The one-channel linear induction acceleration blocks are linked by means of the turning systems, each of which connects the output of one of the one-channel linear induction acceleration blocks with an input of another similar block. This does not concern those inputs, which are connected with injectors; and those outputs, which are destined for coming out the accelerated partial beams.

The method describing connection of the one-channel linear induction acceleration blocks and the turning systems gives an undulative-like form of the working acceleration channels in the MIUNIAC. This means that the charged-particle beams pass the undulative acceleration channels by undulative trajectories. That is why this class of accelerators is named as undulative accelerators.

The output systems are attached to the outputs of the undulative acceleration channels. A characteristic of this design is that the turning systems are made from bipolar permanent magnets or permanent (or quasi-permanent) electromagnets.

The advantage of the discussed design solution results in the compactness of the EH-accelerators and its lower cost as compared with the two other types accelerators. For example, in a case that EH-accelerator is built on the basis of the one-channel acceleration blocks ATA-type (OILINAC), then when constructed with 5 turnings the total length of the system decreases e.g. from, for instance, 60 m to 10 m.

Like the MILINAC, the EH-accelerators are suitable for a simultaneous acceleration of a few charged-particle beams, including the beams composed of different kind of charged particles.

The shortcomings of the known design solution are: large current losses of the beam during the acceleration process, low efficiency, and limitated current of the accelerated beam.

The large losses of the beam current are caused basically by the imperfect structure of the turning systems. As it was mentioned above, they are based on two-polar magnets. This shortcoming of the EH-accelerators is manifested primarily as significant losses in beam current in the process of its transportation through the undulative acceleration channel. These losses are caused by the effect of three physical mechanisms.

The first of these mechanisms is related with the beam-dispersion effect in the magnetic field of the turning system. The essence of the effect is in the following: The real charged particle (for instant, electron) beams, which are formed by the injectors, exhibit always some distribution of energy of the particles. As a consequence, the turning radii of different electrons in the working space of the turning magnets exhibit electron scattering that depends on the turning radii. This means that the specific dimension of a beam at an entrance to each turning is smaller than its dimension at the outlet. As a result of this, with each turning the amount of the particles, which in the process of acceleration "doesn't join" into the geometry of the subsequent linear acceleration channel, increases. These particles systematically settle down on the walls of this channel entrance.

The second of the above-mentioned mechanisms is related with the Coulomb's repulsion of the beam charged particles. An additional displacement of the particle trajectories within the cross-section of a turning is caused by the Coulomb's repulsion. This increases additionally the amount of particles, which doesn't get into cross-section channel and remains beyond the acceleration channel. Because of this, to achieve a turning for a beam having a beam current strength higher than ~100 A is practically not realistic. Hence, the second mechanism of the loss of the beam current is related with the limitation of the beam-current strength in the acceleration channel.

The third physical mechanism of the loss is related with an increased inclination for the instability excitation in a beam at an increase of beam current strength. The beam looses its shape and finally is settling down on the walls of a channel as consequence of this instability. One should stress that the probability of the development of instability is larger the lower is the energy of beam's charged particles. Therefore, in the process of acceleration the probability of beam-instability development decreases. Consequently, like in the case of the previous mechanism, this mechanism limits the current intensity that can be accelerated in the EH-Accelerator. As it follows from the said above, these limitations are more pronounced in the first one-channel acceleration blocks.

Specific features of the turning systems of the EH-accelerator results in their low efficiency. The turning systems, which are used, are suitable to turn a beam for 180° without losses only in the case of the electron-beam current up to ~50 A. However, at an additional increase of current strength (~100 A or higher) the beam is unable to pass through the two-polar magnetic turning systems without scattering. This phenomenon was already discussed above. It is well known that the basic total losses of energy in the OILINAC and MILINAC-type induction systems are due to the demagnetization of the inductor cores. Moreover, these losses are weakly dependent on the current strength of the beam, which is undergoing acceleration, and they basically depend on the core material. This means automatically that the suitable values of the efficiency cannot be achieved at all for the known design of EH-accelerator because of the mentioned limitation of the beam current.

Following is a more detail explanation of the conclusion obtained: the energy losses in the core practically are independent, as it is mentioned, of the current strength of the accelerating beam. The energy, which is transferred to the beam in the process of acceleration, should be treated as the useful energy. As it is well known, this energy is directly proportional to the current strength of the beam. These relationships determine the main way of an increase of the EH-Accelerator efficiency. The experience showed that at ~1 kA beam current strength, the losses within the core are approximately equal to the energy obtained by the beam in the process of the acceleration. Therefore, the high efficiency of the OILINAC-type electron accelerators can be realized only in a case of high current strength, >1 kA. As it was shown before, at this strength electron beams cannot pass through the turning systems in this case of EH-accelerators because of the above-discussed limitations for beam current.

BRIEF SUMMARY OF THE INVENTION

This invention is addressed to a design of a commercial-type multi-channel induction undulative accelerator, which is characterized by small losses of beam particles in the process of acceleration, high efficiency, and high magnitudes of the beam current strength.

Such features are achieved by providing a multi-channel undulation induction accelerator (MIUNIAC) of charged particles, comprising:

an injector block, a drive source, output systems, turning systems, and an induction acceleration block, which is made in the form of at least two one-channel linear induction acceleration blocks (including those that are placed parallel of one to other), linked by means of the turning systems, each of which connects the output of one of the one-channel linear induction acceleration blocks with an input of other similar block, apart from those inputs, which are connected with injectors, and those outputs, which are destined for coming out as accelerated partial beams, in which:

at least one of the turning systems is made in the form of a sequence of fragments of solenoid, which are joined with each other in such a manner that they form a working channel for the charged particle beam, which accomplish a 180° or a smaller angle turn.

Four different structural variants of the MIUNAC are proposed.

The first one has at least one of the fragments of solenoid made in the form of a straight solenoid.

In the second case at least one of the fragments of solenoid is made in the form of a section of toroid.

In the third case at least one two-pole magnet system is placed in the space between the solenoids.

In the forth case at least one of the turning system is made in the form of a systems for merging together at least two beams of charged particles into one joint beam.

Building of the multi-channel induction undulative accelerator of charged particles, totally with all the essential characteristics, including above described different structural variants of the turning systems, allows to realize a situation when a beam in the working channel of a turning system moves under the action of a focusing magnetic field and, consequently, the beam cross-section does not expand beyond the allowed limits during the total process of a turning. In accordance with this, the losses of the electrons in the turning system decrease essentially as well as on the walls of the accelerating channels. Besides this, the conditions are created, which allow for simultaneous merging together (by using the multi-channel turning system) of a few beams, which are accelerated in a few one-channel linear induction acceleration blocks, into a singular beam that is subsequently directed into the following one-channel block. The maximal current strength of current that is accelerated in the subsequent acceleration channels increases because of this process without increasing the probability of instabilities excitation.

DETAILED DESCRIPTION OF THE INVENTION

Figure 1:
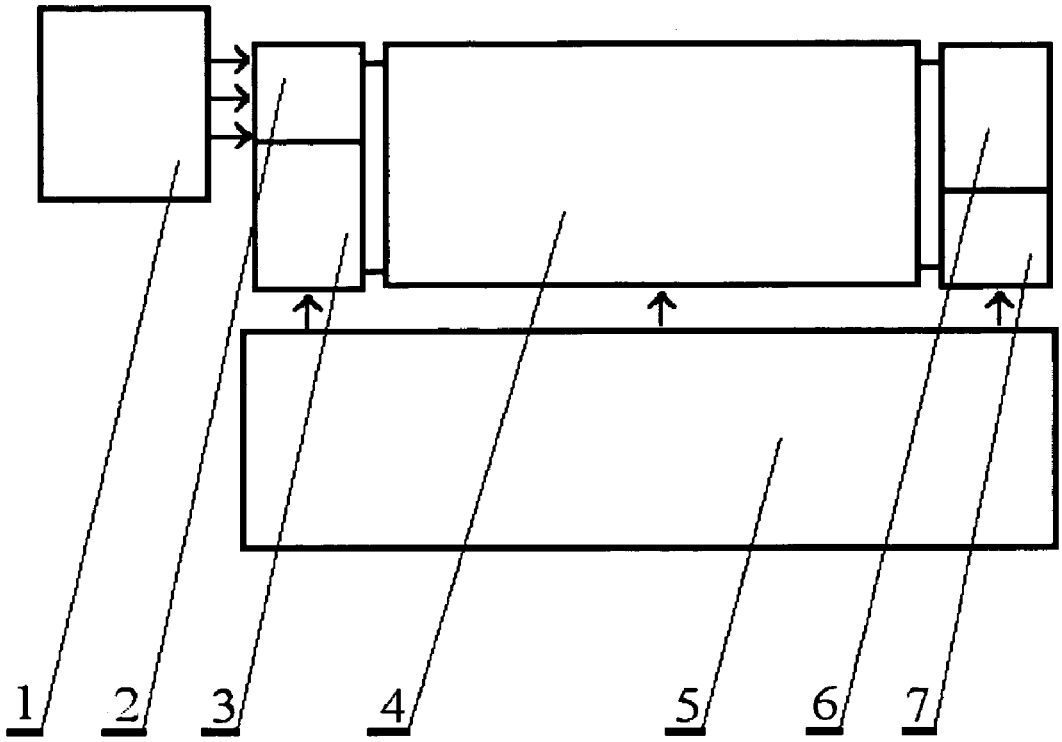
FIG. 1 is a schematic representation of the structural electric scheme for the multi-channel induction undulative accelerator (MINIAC)

The multi-channel induction undulative accelerator (MIUNIAC, see FIG. 1) consists of an injection block 1; a block of input devices for charged-particle beams (input block) 2; and the frontal part of the block of turning systems 3; which are attached to the multi-channel acceleration block 4; The drive source 5 is attached to the acceleration block 4 and the injector block 1. The back part of the turning block 6 and the output systems 7 are attached to the multi-channel acceleration block 4 from the opposite side. Placing all injectors of the block 1 opposite of only one side of the multi-channel acceleration block 4 is not essential for this design. Variants of the design are proposed also where the injector block has a form of not less than two sub-blocks that are positioned at the opposite sides of the multi-channel acceleration block 4. Also the design variant is proposed in which the injector block 1 encompasses sources of different kinds of charged particles. It includes the sources of electrons and of positive and negative ions.

Figure 2:
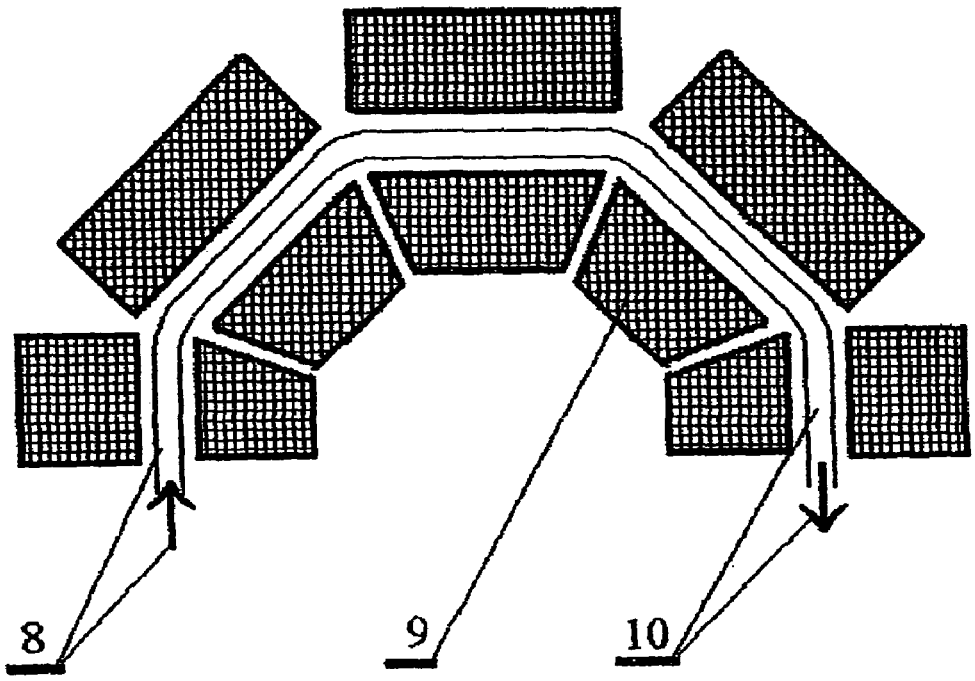
FIG. 2 shows the structure of a turning system having a form of consecutive sections of straight solenoids.
Figure 3:
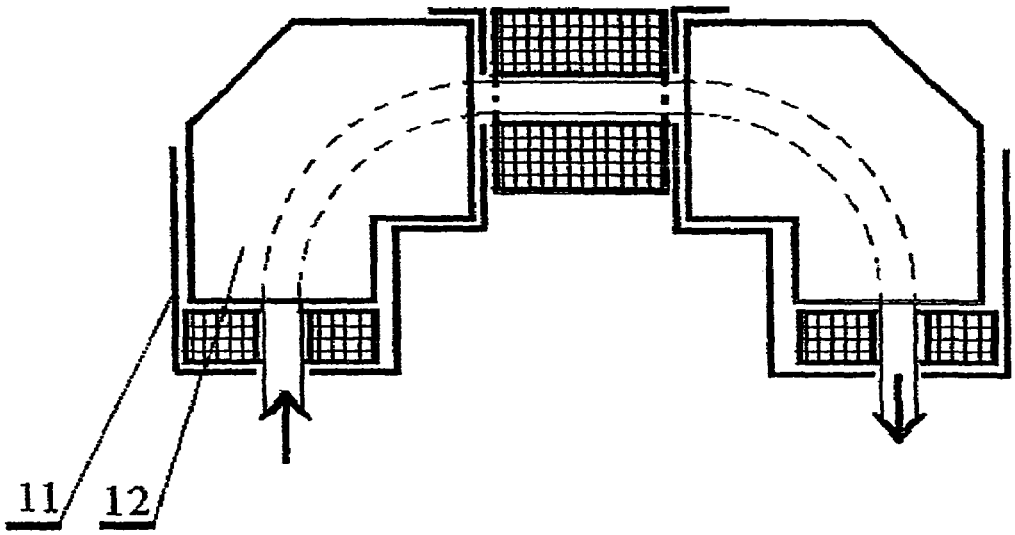
FIG. 3 shows a design example of a turning system having three sections of straight solenoids separated by two bipolar magnetic turning systems.
Figure 4:
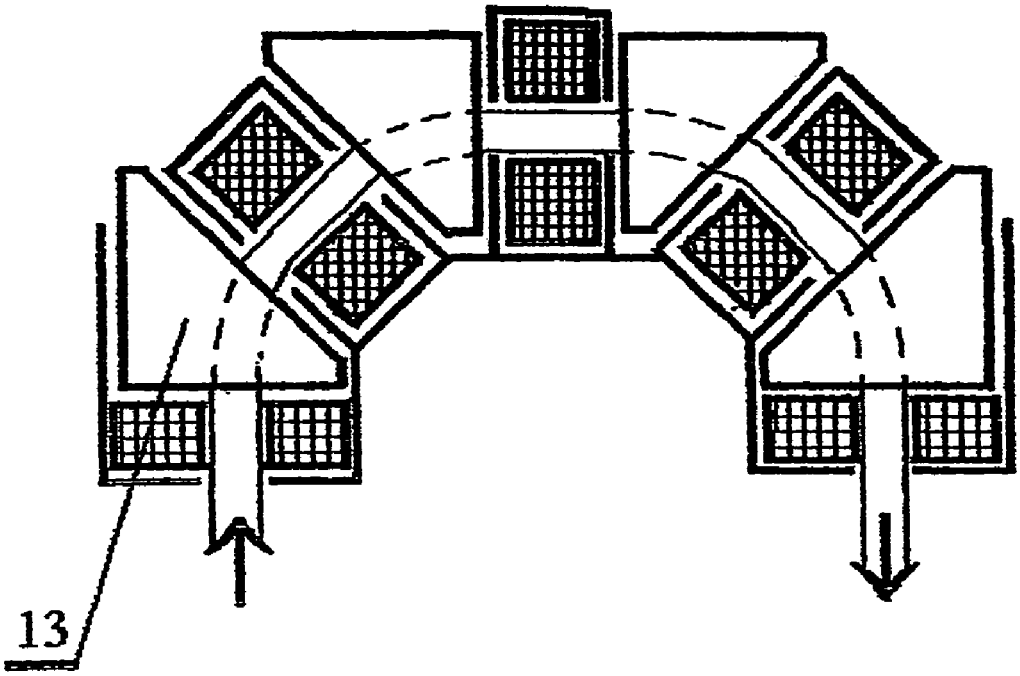
FIG. 4 shows a design example of the turning system composed of five consecutive segments of solenoids having four two-polar magnetic turning systems in interspaces.
Figure 5:
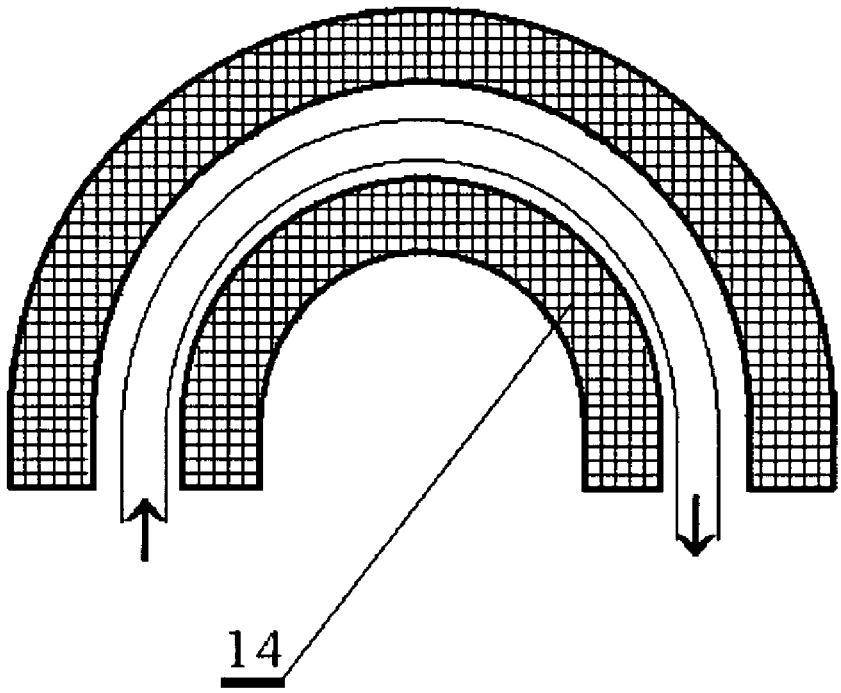
FIG. 5 shows the design example of the turning system made in the form of toroid segment.
Figure 6:
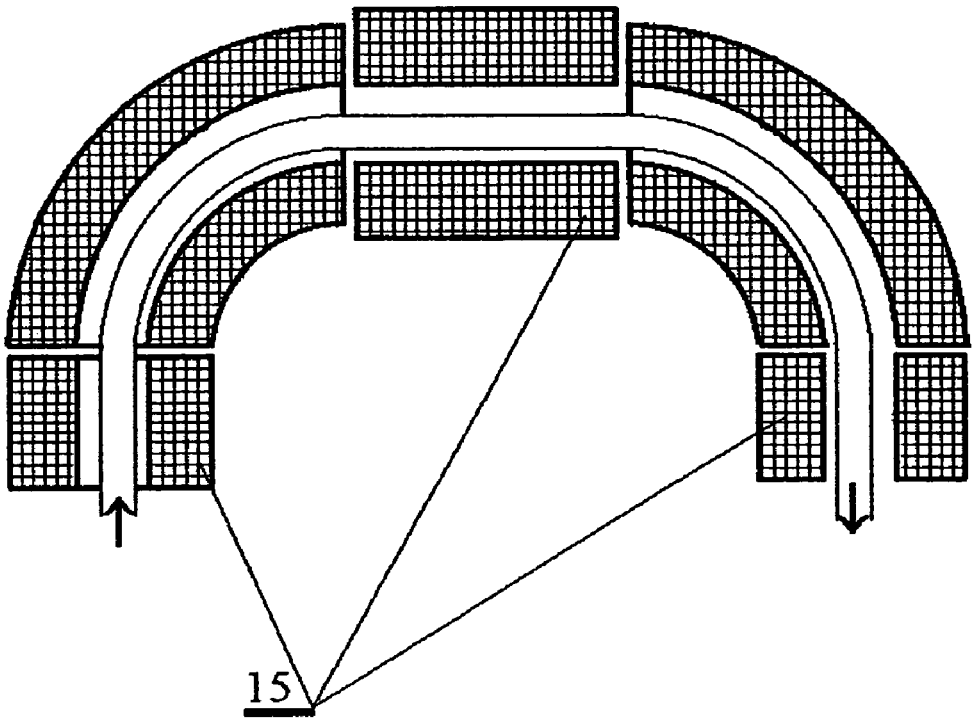
FIG. 6 shows a turning system, which is made in the form of two toroid segments, which are placed between three sections of straight solenoids.

In the design example, shown in FIG. 2, at least one of the turning systems of the blocks 3 and 6 has a form of subsequently joined straight sections of solenoid 9. They are joined in the way in which the directions of the input beam 8 and the output beam 10 of charged particles are mutually opposite. It means they realize the beam turn for 180°. The peculiarity of the design in FIGS. 3 and 4 is that the two-polar-magnet turning systems 12 and 13 are placed between the straight solenoid sections 9. The difference between the variants in FIG. 3 and FIG. 4 is as follows. In the variant in FIG. 3, there are two two-polar magnetic systems 12, each of which secures a beam 8 turning for 90°, when in the case of the functionally similar variant shown in FIG. 3 there are four two-polar magnetic systems, each of which secures a 45° turning. The design variants having a higher number of the two-polar magnetic turning systems are foreseen. Each of the design variants in FIG. 2 to FIG. 4 allows the usage of magnetic screens, which are positioned at the input and the output to the turning system as well in spaces between the solenoid 9 and magnets 12, 13 on one side and the sections of solenoid 9 on the other side. In the design variants shown in FIG. 5 and FIG. 6, the solenoid has a form of toroid sections securing the beam 8 turn for 180°. In addition to this, when in the case of the variant in FIG. 5 the total turn is secured by only one section of toroid 14, in the case of the variant shown in FIG. 6 the turning system has a form of two sections of solenoids, each of which secures a turn for 90° placed between three straight solenoid sections 15. A variant is also foreseen of the design having a higher number of toroid sections than two. However, in all the cases, the total turn, which the toroid sections provide, is 180° or less.

The performance of the invention depends on the following: Injectors, which are in block 1, form the beams of charged particles. Then these beams are guided into the input of the acceleration channels of the one-channel linear acceleration blocks, which are in block 4. The entering of the beams is achieved by the use of the entrance devices of block 2. Then the beams are accelerated in the channels of block 4 and are guided to the entrance to the turning system of block 6. Each of the turning systems is linked, in its turn, into the input of other (one or more) acceleration channels of block 4. In the example considered the beams are accelerated and guided to one of the inputs of the block 3. The accelerated beams are removed from the output system 7 of the accelerator. The electron accelerators as well the accelerators of ionic beams, and the combination electron-ion multi-channel induction undulative accelerators all work in the same way.

The design of the turning systems, which are components of block 3 and 6, is the basic peculiarity of the invention. The turning systems provide turning the beam accelerated without significant losses of charged particles. The latter result is achieved by using focusing properties of solenoids 9, 14, 15. Because of using solenoids the suppression of all above described mechanisms for excessive electron drift to the walls is achieved during the turning process. It includes the drift caused by the effect of Coulomb's repulsion forces between charged particles, initial excessive emmitance of the beam, etc. This suppression along the total turn provides retention of the controlled equilibrium configuration. The latter, in turn, allows to transport the strong-current beams through a series of turning systems without substantial losses of the charged particles.

Using one-channel and multi-channel design variants of the turning systems is proposed. The performance of a one-channel and multi-channel system is explained in FIG. 7 and FIG. 8, respectively.

Figure 7:
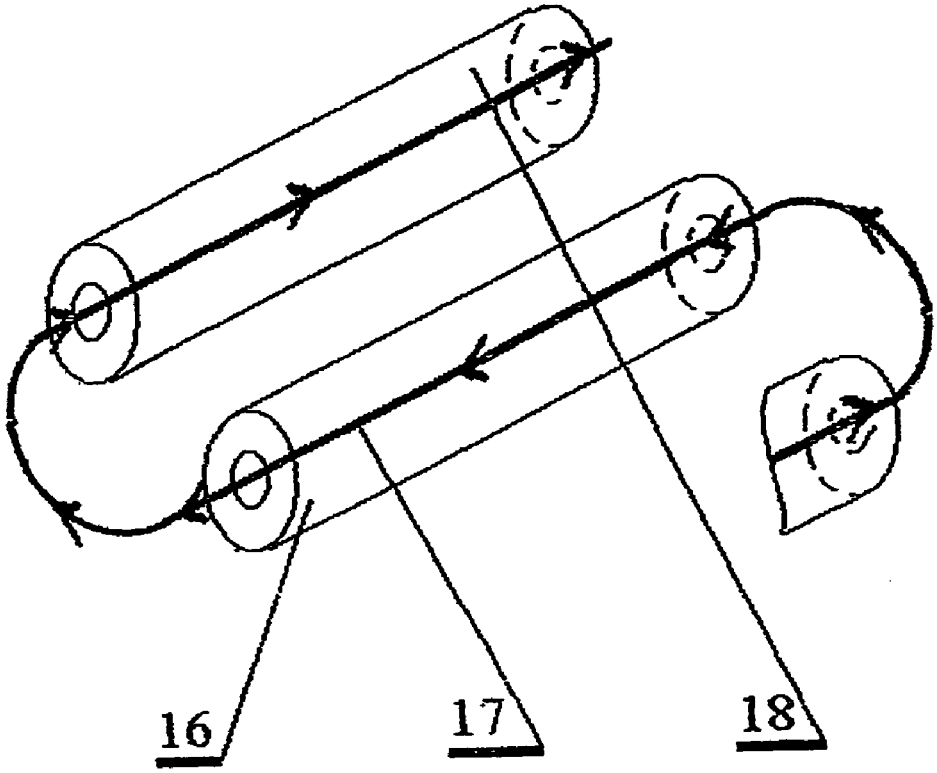
FIG. 7 shows a scheme of beam moving in a multi-channel induction accelerator with the one-channel turning systems.

The scheme of beam motion in the MIUNIAC having one-channel turning systems is given in FIG. 7. Here the beam 17, accelerated in the first linear acceleration block 16, is turned in the working region of the turning system and then directed into the acceleration channel of block 18, etc. Hence, the peculiarity of the MIUNIAC with one-channel turning systems is that that one output of the acceleration block is joined by the turning system with one input of the next acceleration block.

Figure 8:
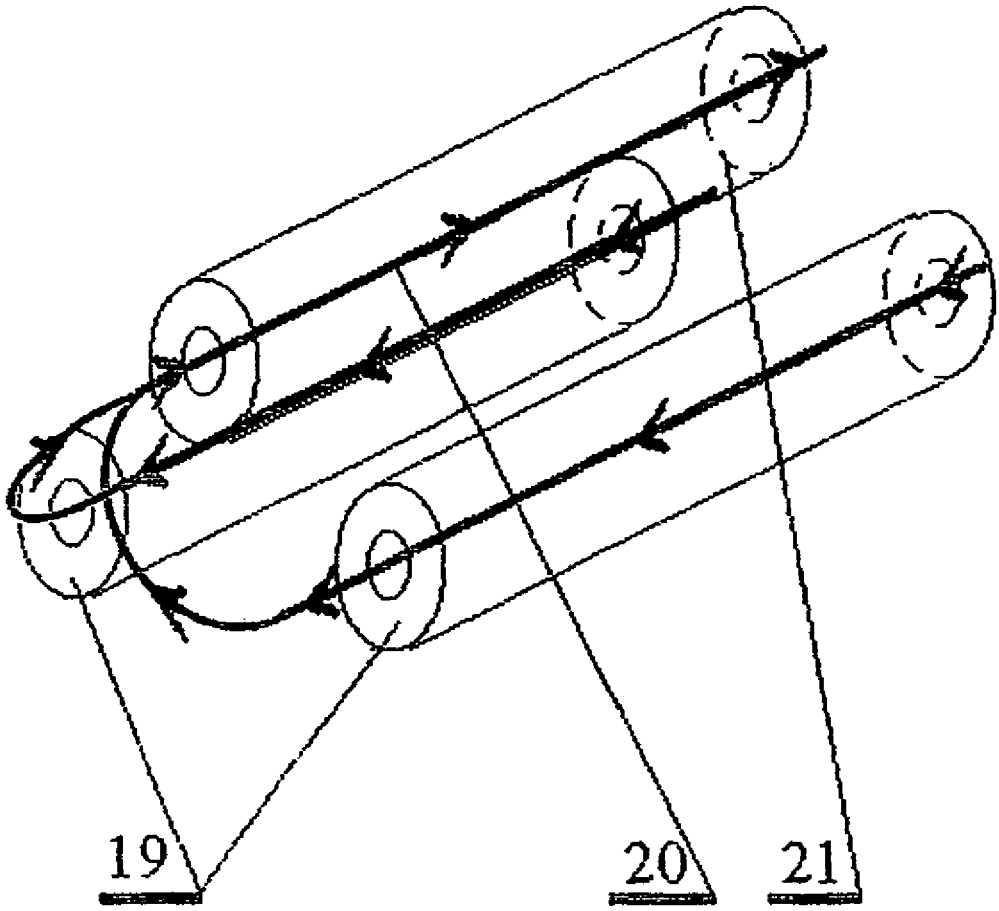
FIG. 8 shows motion of a beam in multi-channel induction accelerator with two-channel turning systems.

The principle of work of the MIUNIAC having multi-channel turning systems is illustrated in FIG. 8. This is done by the simplest example of the MIUNIAC with a two-channel turning system. Here two beams 17, from two linear acceleration blocks 19, combine within the turning process into the single beam 20, which then is directed into the next linear acceleration block 21, and so on. This scheme is especially promising for a case when the MIUNIAC is used for the formation of the relativistic electron beams with current strength of hundreds of kA's. As it was mentioned before, the low-energy electron beams, having current strength ~100 kA and more, exhibit an increased inclination to excite beam instabilities. The formation of the instabilities automatically ruins the beam geometry. Like in the OILNIAC, also in the MIUNIAC, this happens especially in the first stage of acceleration, when a beam did not acquire yet enough of energy, i.e., the charged particles are "too light". In the course of an increase of electron energy (and a respective increase of their relativistic mass) a beam becomes more stable. This effect is used in the basis of the electron OILNICA with multi-channel turning systems.

Let us analyze as an illustration example the design of MIUNIAC with multi-channel turning systems and two turns of accelerated beams. Let assume that, say, a four-channel turning systems and the injector block, consisting of 16 electron injectors are used. Let's accept that injector forms electron beams with current strength 25 kA each, the one-channel induction acceleration blocks are characterized by the acceleration rate 2 MeV/m, and length of each of them is L~10 m.

After the first acceleration and turnings together, the 16 initial beams transform into four beams with total current 100 kA each. Therein each of total 100 kA-beams does not loose its stability in spite of the high magnitude of current strength. The explanation of this effect is the following. The point is that the relativistic masses of electrons increase during the first acceleration from $\gamma_{inj}$~3 to $\gamma$~33 because of the effect of relativistic mass (here $\gamma=(E+E_0)/E_0$ is the relativistic factor, $\gamma_{inj}$ is the relativistic factor of each of beams generated by injectors, E is the electron kinetic energy, and $E_0$ is the electron rest energy). As analysis shows, the following criteria should be kept for supporting the total beam stability during the beam merging together:

$$I/\gamma_{inj}^3 \geq nI/\gamma^3$$

where I is the strength of beam current, n is the number of merged together beams. It is considered that the injectors form stable beams. One can be easily assured that this condition is satisfied after each beam acceleration, turning, and merging together because the mentioned effect of the increasing electron mass. It is readily seen that the increasing the beam current (as a result of the merging together procedure) is completely compensated (with a good reserve) by increasing the electron relativistic mass.

Then after the second turning the four 100 kA beams and their merging together we obtain a single 400 kA total beam with energy 60 MeV. Therein the total accelerator length does not exceed 12–13 m. It should be mentioned that today this appears as a record of these parameters for the considered class of electron accelerators.

The invention allows using the accelerator as a commercial-type compact accelerator of charged particles, including singular and multiple parallel relativistic beams of charged particles.

What is claimed is:

1. A multi-channel undulation induction accelerator of charged particles, comprising:

an injector block;

a drive source;

output systems;

turning systems;

an induction acceleration block, which is made in the form of at least two one-channel linear induction acceleration blocks (including those that are placed parallel with one to other), linked by means of the turning systems, each of which connects the output of one of the one-channel linear induction acceleration blocks with an input of another similar block, apart from those inputs which are connected with injectors, and those outputs from which accelerated particles are expressed; and wherein:

at least one of the turning systems is made in the form of a sequence of fragments of solenoid, which are joined with each other in such a manner that they form a working channel for the charged particle beam, which accomplish a 180° or less angle turn, said sequence of solenoid fragments being positioned about said working channel.

2. The multi-channel undulative induction accelerator of claim 1, in which:

at least one of the fragments of solenoid is made in the form of a straight solenoid.

3. The multi-channel undulative induction accelerator of claim 1, in which:

at least one of the fragments of solenoid is made in the form of a section of toroid.

4. The multi-channel undulative induction accelerator of claim 1, in which:

at least one two-pole magnet system is placed in the space between the solenoids.

5. The multi-channel undulative induction accelerator of claim 1, in which:

at least one of the turning system is made in the form of a system for merging together at least two beams of charged particles into one joint beam.

* * * * *